United States Patent [19]

Ridge et al.

[11] Patent Number: 4,973,965

[45] Date of Patent: Nov. 27, 1990

[54] PASSIVE RADAR TARGET

[75] Inventors: Leslie D. Ridge, London; Clifford Rix, Hampshire, both of England

[73] Assignee: The Secretary of State for Defence in Her Britannic Majesty's Government of the United Kingdom of Great Britain and Northern Ireland, London, England

[21] Appl. No.: 466,427

[22] PCT Filed: Jul. 10, 1987

[86] PCT No.: PCT/GB88/00489

§ 371 Date: Mar. 12, 1990

§ 102(e) Date: Mar. 12, 1990

[87] PCT Pub. No.: WO89/00773

PCT Pub. Date: Jan. 26, 1989

[51] Int. Cl.[5] ..... H01Q 15/23

[52] U.S. Cl. ..... 342/11; 343/911 R; 343/911 L

[58] Field of Search ..... 342/11; 343/911 R, 911 L

[56] References Cited

U.S. PATENT DOCUMENTS

| | | | |
|---|---|---|---|
| 3,079,289 | 2/1963 | George, Jr. et al. | 154/43 |
| 3,145,382 | 8/1964 | Cuming et al. | 343/18 |
| 3,307,187 | 2/1967 | Horst | 342/11 |
| 4,224,626 | 9/1980 | Sternberg | 343/911 |
| 4,288,337 | 9/1981 | Ota et al. | 252/512 |
| 4,482,513 | 11/1984 | Auletti | 264/39 |

*Primary Examiner*—Thomas H. Tarcza

*Assistant Examiner*—Mark Hellner

*Attorney, Agent, or Firm*—Nixon & Vanderhye

[57] ABSTRACT

A passive radar target comprises a sond lens (50) of substantially uniform dielectric constant, having a reflecting surface (51) integrally formed therewith, the lens being constructed of particulate material having a dielectric constant selected such that radar waves striking the surface of the surface of the lens are focussed on the reflecting surface. In one form the particulate material comprise silica flour (91, 101) contained within a thin radar transparent polycarbonate shell. The shell is formed of two similar halves (102, 103) with a pressed aluminum reflective lining (92, 106) in one half. By making the lens axially symmetrical such that the forward and rearward surfaces have a radius of curvature that decreases with distance from the axis of symmetry (102, 103) the lens-reflector can be made to operate over a wide solid angle. In addition the paths of the reflected energy can be made slightly divergent since this has been found to optimise the reflected intensity and to provide the capability for detection of the target by a receiver spaced from the transmitter. Two such lens-reflectors back-to-back will provide substantially omnidirectional operation. In an alternative arrangement back-to-back concave reflecting surfaces (114, 115) are centrally located within a single spherical shell (117) filled with particular material (116). In some applications a particulate filler such as powdered slate is held by means of a polyurethane foam.

11 Claims, 6 Drawing Sheets

PASSIVE RADAR TARGET

The invention relates to radar reflectors or targets and in particular to lens arrangements for enhancing the radar cross-section of a target.

Radar reflectors such as trihedral corner reflectors are frequently carried on the masts of yachts to enhance the. radar cross section for the yachts' safety by making them more visible to scanning radars of nearby ships. These reflectors are also used in targets for weapon practice where radar signatures are tailored to simulate practical targets.

Enhanced radar cross sections can also be achieved using lens-reflector assemblies. The best known assembly is the Luneberg lens with reflector. This is a fairly expensive device to make, especially when intended for use at higher microwave frequencies, i.e. above I band. This mainly arises as a consequence of the construction requiring a number of concentric contiguous hollow shells with dielectric constants a function of their radius. The material of the shells has also to be of low loss at the frequencies at which it is to be used. The radar microwaves are focussed by the lens on to a concave reflector and thence through the lens and back towards the radar emitter. This system is passive, involving no moving parts, and when used with missiles or projectiles it is generally made symmetrical about the longitudinal axis of the missile or projectile to produce an axially symmetric response which is independent of any spin. In a projectile application it is necessary for the lens-reflector assembly to withstand high g acceleration and high spin rates and thus careful attention has to be given to the design of this assembly. In this application a metallic reflector is generally held against a portion of the surface of the Luneberg lens by clamping or by adhesive. In addition to ruggedness lens-reflector assemblies are suitable for use with linearly polarised radars (vertical or horizontal polarisation) and also by inserting a suitably spaced grid between the lens and the reflector, correct rotation of the reflected wave can be achieved as required for circularly polarised radars.

One possible solution to the current expensive and complex lens-reflector arrangements is to replace the Luneberg lens by a single spherical lens (ie of uniform dielectric constant), with very little penalty in performance and weight. The performance penalty is almost negligible when compared with crude versions of the Luneberg lens which may have only 3 or 4 shells. The difference in performance stems largely from the fact that the wave front of the reflected wave is not plane, but curved with the solid dielectric lens arrangement, whereas with a true Luneberg lens (ie with an infinite number of shells of differing dielectric constant), the wavefront is plane. The solid dielectric lens can be made more simply than the Luneberg lens, however the focussing of such lenses depends upon the dielectric constant of the material and unless a suitable material is available to focus the microwave energy on the back surface of the lens it is necessary for there to be an air gap between the lens and the reflector. This adds a constructional difficulty particularly where a robust lens-reflector assembly is necessary.

The object of the present invention is to provide a robust lens-reflector assembly which can be simply constructed. A secondary object is to provide such an assembly which can be made more cheaply than previously possible.

The invention provides:

a passive radar target comprising a solid lens of substantially uniform dielectric constant, having a reflecting surface integrally formed therewith, the lens being constructed of particulate material having a dielectric constant selected such that radar waves striking the surface of the lens are focussed on the reflecting surface. The particulate material may be held together within a constraining envelope, it may be bound together by means of an adhesive or it may be held together by means of a foam plastics material. The reflecting surface may be applied to the outside of the lens or may preferably be inside where it is free from environmental contamination or damage.

In one form the reflecting surface may be in contact with one portion of the surface of the lens such that radar waves striking other portions of the surface of the lens are focussed on the reflecting portion. The extent of the reflecting surface will depend upon the required angular response. It will thus be possible to tailor the response according to the application. In a small projectile where maximum enhancement is required in a given direction the lens may be spherical and the reflecting surface preferably covers a hemisphere of the lens and may be a coating applied by spraying.

Preferably the lens is axially symmetrical having forward and rearward surfaces, the reflecting surface being in contact with the rearward surface. In one form the lens may be spherical with the reflective surface preferably covering the whole of the rearward surface. In one arrangement the forward and rearward surfaces have a radius of curvature that decreases with distance from the axis of symmetry. In this latter arrangement it has been found preferable for the forward and rearward surfaces to have differing radii of curvature at the axis of symmetry. In such an arrangement the radar target can be made to have a high reflectivity throughout a solid angle of substantially $2\pi$.

The particulate material of the lens may be quartz (fused silicon dioxide). Quartz has a dielectric constant close to the ideal for use in a spherical lens. In addition quartz has good low loss properties, making it a very suitable material. A cheaper material with a close dielectric constant is sulphur. In an alternative arrangement therefore the lens may include particulate sulphur. This may be in the form of a sulphur composition bonded in vacuum with an epoxy resin. The dielectric constant of the bonded sulphur however is too large for a perfect spherical lens. By forming the lens of two hemispheres such that the reflecting portion or hemisphere has a smaller radius of curvature than the other portion or hemisphere, the waves can be brought to focus at the reflecting surface. Sulphur bonded lenses have relatively high losses at microwave frequencies due to the dielectric losses in the epoxy resin binder. This choice of binder is determined by the need to minimise deleterious heating effects on the sulphur. A polyester resin binder when used did not cure.

An advantageous arrangement uses a spherical lens made of silica glass beads or silica flour with a polyester resin binder. By varying the relative weights of binder and particulate silica the dielectric constant can be adjusted to the required value for focussing on the reflecting surface. In addition the lens can be made using inexpensive materials in a convenient moulding process. The presence of the binder can be used to advantage to maintain a relatively constant radar cross section over a range of microwave frequencies: since the binder losses probably increase with frequency as also does the radar cross section normally, these two frequency dependent effects will to some extent balance each other.

In a particularly advantageous arrangement the particulate material . is contained within a thin, radar transparent shell, such as polycarbonate or ABS. This obviates the need for a binder. In this arrangement the reflecting surface can be provided on the inside of the shell and in contact therewith. This provides a particularly cheap and robust lens-reflector assembly. The shell may be conveniently made in two identical forward and rearward hemispherical portions and the reflector may be a metal pressing inserted inside the rearward portion before assembling the portions together. Advantageously an aperture is provided in the shell for filling the sphere with the particulate material. Alternatively the shell may be filled with a plastics foam such as a polyurethane loaded with a particulate filler. One filler which has been used with a polyurethane foam is powdered slate.

In the lens-reflector assemblies of the present invention the performance efficiency is not significantly dependent upon the smoothness of the lens and thus polishing of the surface is not necessary. In addition to being cheap, lenses according to the invention: produce radar cross-sections comparable with the simple conventional Luneberg lens-reflector assemblies; produce substantially uniform response over a wide included angle cone (in the case of a spherical lens of substantially 120°); and can operate up to the J, K and L bands of frequencies and higher.

The reflecting surface may be formed as a vaned grid on the surface so that the radar target can be used for circularly polarised radar.

The invention will now be described by way of example only with reference to the attached drawings of which:

Figure 1:
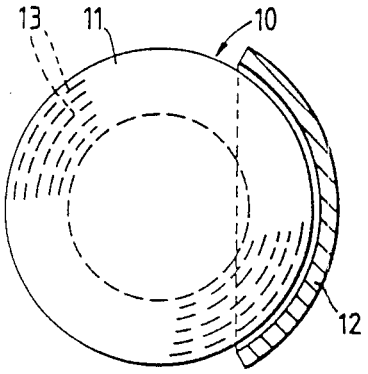
Fig.1. PRIOR ART
FIG. 1 shows a known passive radar enhancing lens-reflector assembly.
Figure 9:
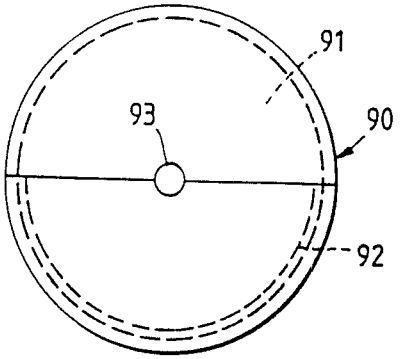
FIG. 9 shows an alternative spherical lens design.
Figure 10:
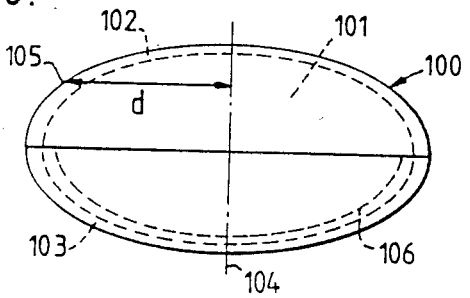
Figure 11:
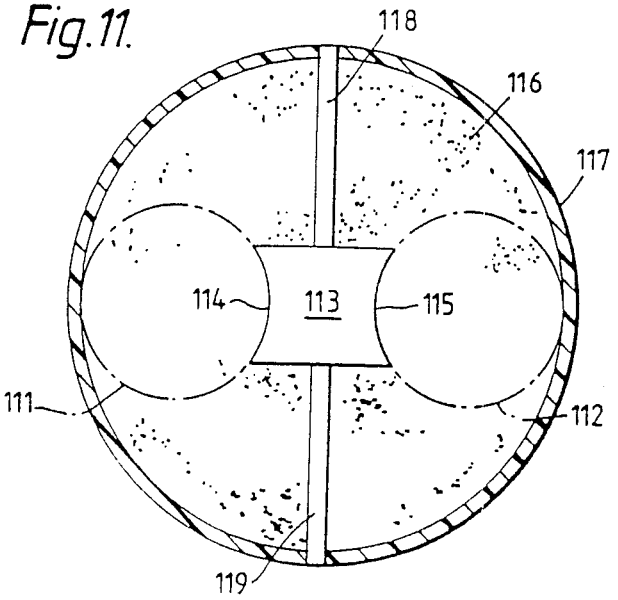

FIG. 10 shows a more complex shaped lens design similar in construction to FIG. 9; and FIG. 11 shows a sectional view of a lens-reflector assembly giving substantially omnidirectional performance FIG. 1 shows a known radar enhancing lens-reflector combination comprising a Luneberg lens 11 and a reflector 12. The Luneberg lens 11 comprises a plurality of contiguous thin spherical shells 13 arranged such that the dielectric constant of each successive outer shell is greater than the next inner shell. The lens is designed to focus microwave energy of a desired frequency band on to the rear surface of the lens. The reflector 12 comprises a plastic part-spherical shell formed by moulding and provided with a metallised reflecting layer on its inner concave surface.

Figure 2:
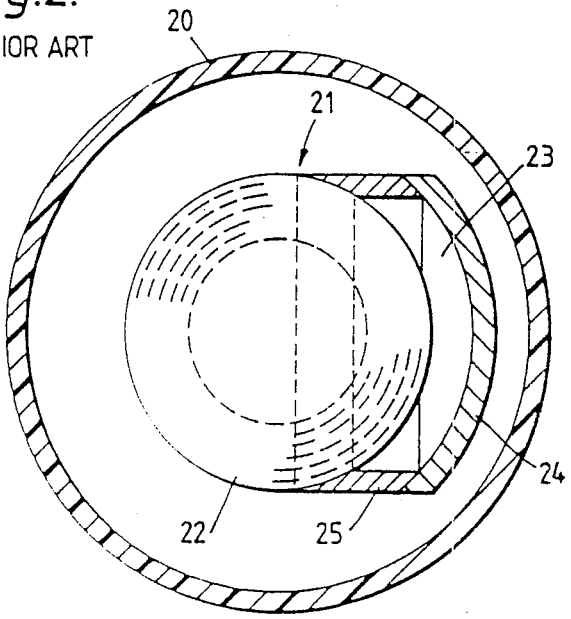
Fig.2. PRIOR ART
FIG. 2 shows a second known solid lens-reflector assembly within a protecting housing.

One application of the use of radar enhancement is a mast-head target reflector for a yacht as illustrated in FIG. 2. Housed within a radar-transparent housing 20 is a known lens-reflector assembly 21 of alternative design to FIG. 1. The lens 22 is a solid perspex lens which focuses incident microwave energy behind the lens. Because the dielectric constant of perspex is non-optimum it is supported such that there is a fixed gap 23 between the lens 22 and the reflector 24 whereby the microwave energy is focussed on to the reflector. The gap 23 is filled by a suitable filler material to provide mechanical support for the assembly. A radar absorbing annular ring 25 is provided to seal the gap 23 to prevent incident radar waves from entering the gap 23 directly without traversing the lens.

These types of lens-reflector assembly may also be used as practice targets and may be carried by one type of projectile to simulate another. When carried in a projectile the lens-reflector system must be capable of achieving the required radar cross section, and must be robust enough to withstand the severe environment experienced during firing of the projectile, subsequent high speed rotation as it travels through the atmosphere, and also heating by means of friction of the oil on the projectile surface.

In its simplest form the present invention employs a generally spherical lens with a reflecting coating applied directly to a portion of the surface of the lens to produce a mechanically simple and robust arrangement which can be used in the above applications.

Figure 3:
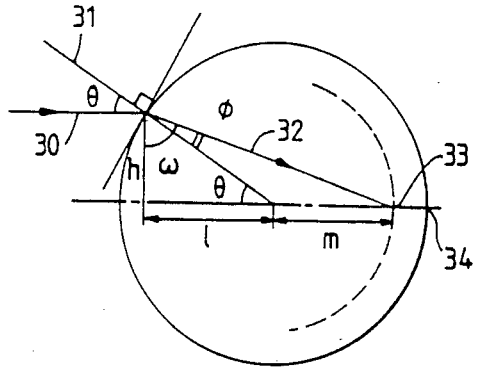
FIG. 3 illustrates the parameters used in calculating the optimum dielectric constant of a spherical dielectric lens.

The focussing of rays by a solid lens of dielectric constant $\epsilon_s$ is illustrated with reference to FIG. 3.

At the front surface of the lens the rays are refracted according to Snell's law such that:

$$\sin\theta = k\sin\phi \qquad (1)$$

where $\theta$ is the angle of incidence of the ray 30 with respect to the normal 31, $\phi$ is the angle of the refracted ray 32 to the normal 31 and k is the refractive index.

The refractive index is given by:

$$k = \sqrt{\epsilon_s} \qquad (2)$$

The radius m at which focus will occur is given by:

$$m = R\,[\sin\theta\tan(90-\theta+\phi) - \cos\theta] \qquad (3)$$

where R is the radius of the lens.

The rays are focussed on to the rear surface of the lens when equations 1 to 3 are satisfied for m=R with $\theta=45°$ when the dielectric constant $\epsilon_s=3.414$. The point of focus 33 will then be on the rear surface of the lens at point 34. The angle of incidence $\theta=45°$ leading to a dielectric constant of 3.414 is found to achieve the mean or best focus for rays of all incidence Materials with a dielectric constant of 3.414 and also with a low loss (tan $\delta$) at microwave frequencies, however, are either not readily available or cannot readily be engineered into the correct shape. An example of a material having about the correct dielectric constant is quartz (silicon dioxide when fired) quartz spheres are made from single crystals and are expensive to produce. There are, however, readily available materials which have low loss and are easily machineable but have lower dielectric constants than the optimum value e.g. polystyrene and perspex. The use of such materials however causes the microwaves to be focussed behind the rear surface of the lens and therefore requires the provision of an air gap as shown in FIG. 2. This arrangement leads to complexity of construction since the gap between the lens and reflector must be accurately maintained. In addition damage and deterioration of the reflecting surface must be avoided.

Figure 4:
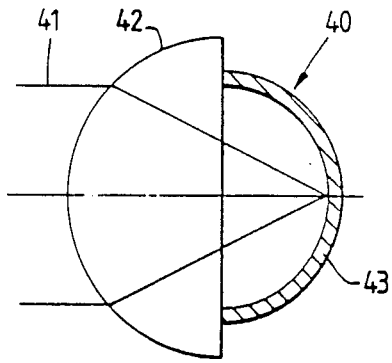
FIG. 4 shows a FIG. 2 lens modified to allow use of a material having larger than optimum dielectric constant.

The inventors realised that by using particulate material held in a generally spherical form of lens, wave reflection can take place at a reflector on the rear surface of the lens. In one form shown in FIG. 4 a lens has been made using a moulded, generally spherical lens of sulphur bound in an epoxy resin. This has a dielectric constant of about 4.0 at a frequency of 1KHz and so rays would be focussed within a true spherical lens. However by modifying the lens moulding as shown in FIG. 4 the 45° rays 41 are brought to a focus on the rear reflecting coated surface 43 of the lens. The composition used comprised:

100g sulphur
100g epoxy resin
50g hardener
2g accelerator

The front hemisphere 42 was made 86mm in diameter and the rear reflecting hemisphere 43 was 68mm in diameter. The estimated loss tan $\delta$ was 0.03. The measured REA results were as follows:

$=0.028m^2$ at 9 GHz
$0.022m^2$ at 13.5 GHz
$=Om^2$ at 35 GHz

Figure 5:
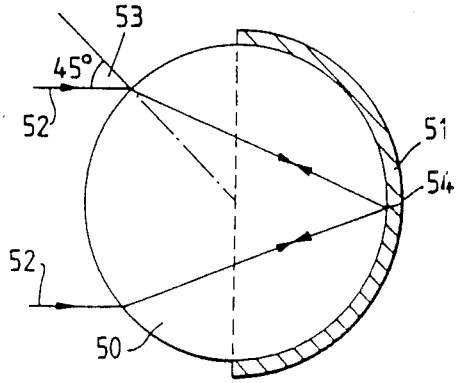
FIG. 5 shows a lens/reflector arrangement where the lens material has optimum dielectric constant.

The effect of the improved focussing plane in the sulphur/epoxy resin lens is masked by the large losses due to the epoxy resin. However this approach may be used with other materials whose properties may be satisfactory in all respects except for a dielectric constant which is too high. An alternative lens is described with reference to FIG. 5. The lens 50 comprises an 86mm diameter moulded sphere made from silica glass beads bonded with polyester resin A zinc spray radar reflecting coating 51 is applied to a thickness of at least 120 microns over a hemisphere. The dielectric constant of the sphere is adjusted by appropriate choice of material proportions to give the optimum value substantially equal to 3.414 at which microwave rays 52 incident at an angle of incidence 53 equal to 45° are brought to a focus 54 at the reflecting surface of the lens.

Figure 6:
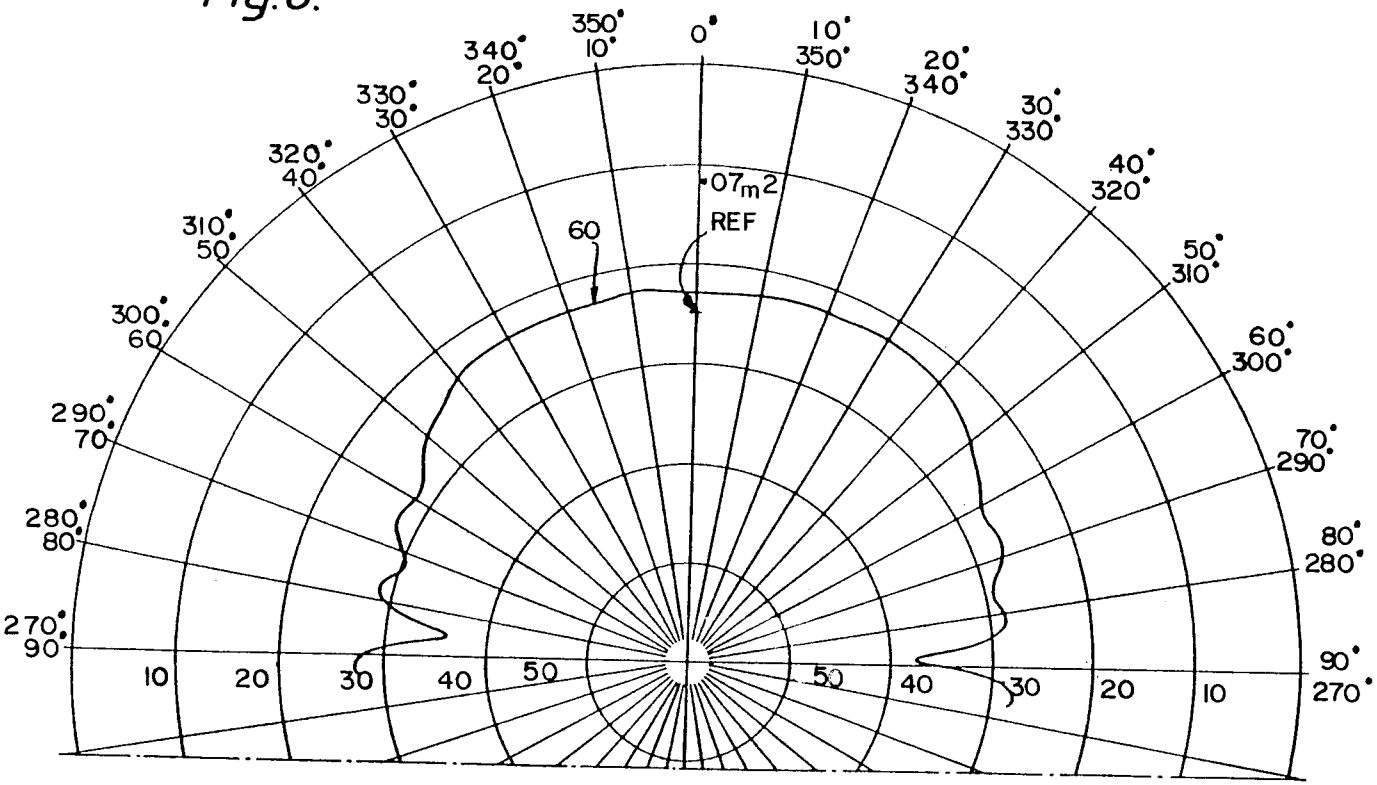
FIGS. 6-8 are the polar response curves of the FIG. 5 radar target measured at 9 GHz, 13.5 GHz and 35 GHz.
Figure 7:
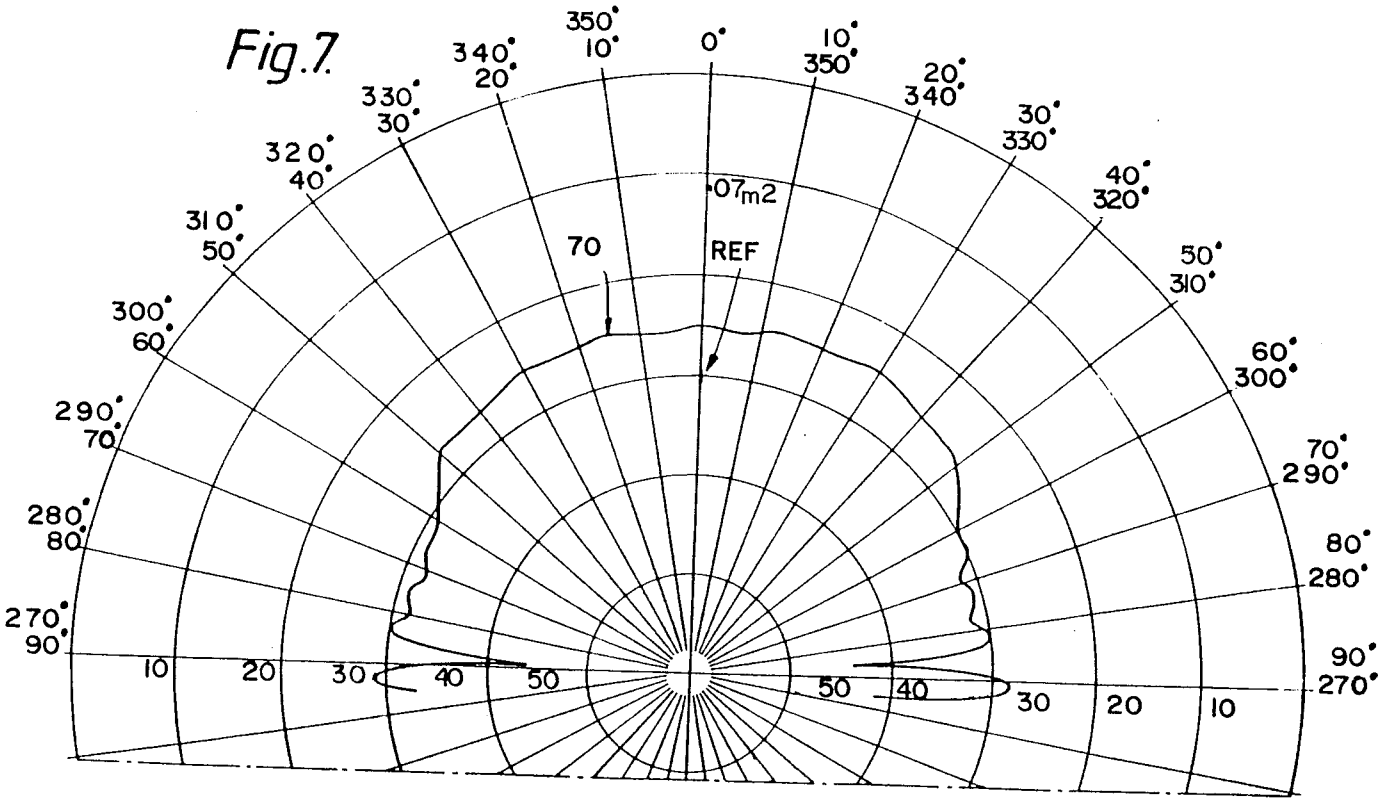
Figure 8:
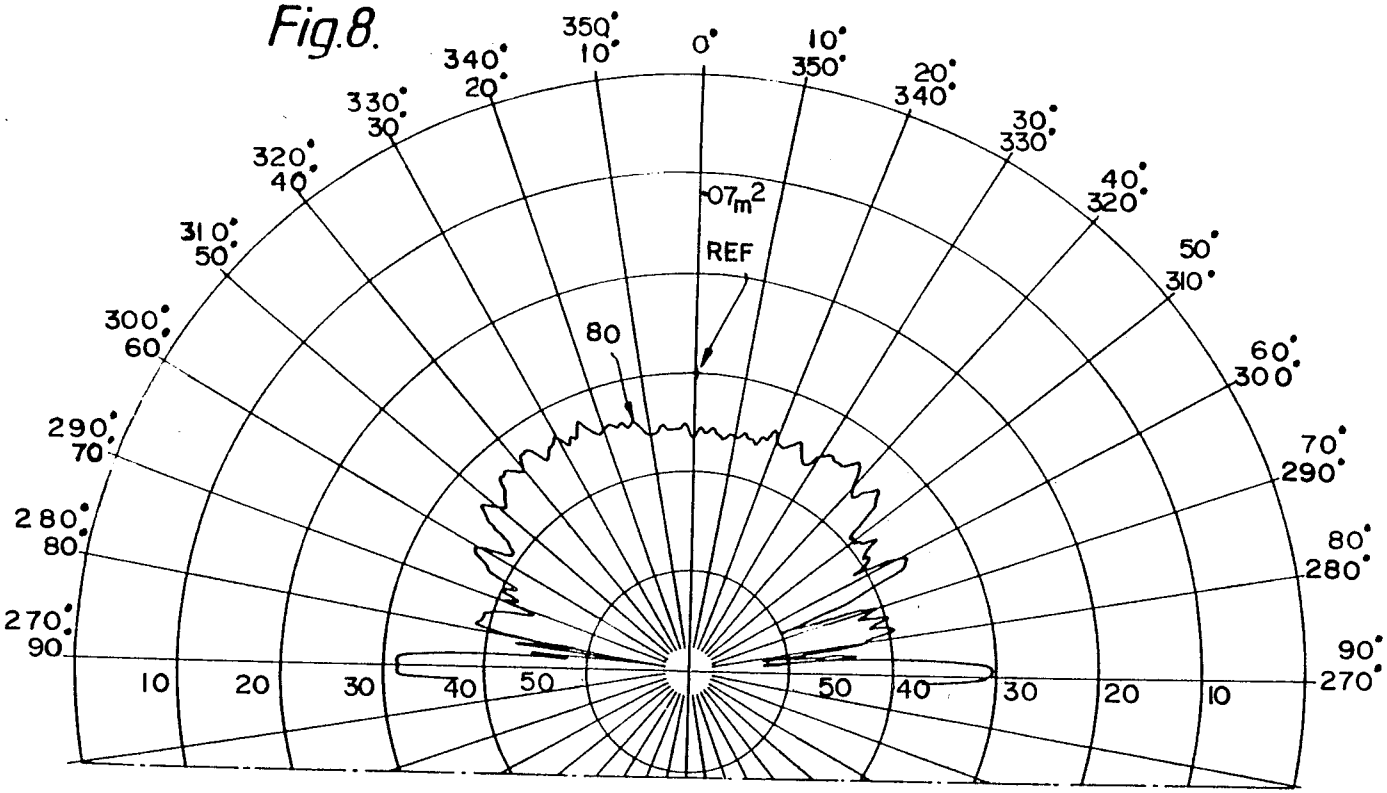

FIGS. 6 to 8 respectively show the polar response curves 60, 70 and 80 for an 86mm diameter lens at 9.0 GHz, 13.5 GHz and 35 GHz. The lens was made up from equal proportions by weight of silica glass beads (Grade 3) and polyester resin (Strand-glass Crystic). The dielectric constant was measured as 3.29 at 1 KHz. The measurements shown were taken in an anechoic chamber.

Assuming that the loss tan $\delta=0.003$ then the calculated radar enhanced area (REA) is:

$=0.18m^2$ at 9.0 GHz
$=0.37m^2$ at 13.5 GHz
$=1.56m^2$ at 35 GHz

These are to be compared with the measured values
$=0.11m^2$ at 9.0 GHz
$=0.22m^2$ at 13.5 GHz
$=0.017m^2$ at 35 GHz The measured value at 35 GHz is low due to the high dielectric loss in the polyester resin at this frequency.

The lens as described above may be improved by replacing the silica beads with silica flour. The measured values of the REA are shown in the Table. Measurements are also shown at the same frequencies for a slightly smaller quartz lens.

| Frequency | Radar Cross Sectional Areas ($m^2$) Silica Flour/Polyester resin (86 mm diameter) | Quartz (76 mm) |
|---|---|---|
| 12 GHz | 0.807 | 0.36 |
| 18 GHz | 1.3 | 0.51 |
| 38 GHz | 1.63 | 2.3 |

These results show that the silica flour/polyester resin lens has better performance than the quartz lens over most of the measured frequency range. The impaired performance of the silica flour compared to quartz at the highest measured frequency is due to the higher dielectric loss.

FIG. 9 shows an alternative, particularly robust lens-reflector arrangement. A hollow moulded plastics ball 90 is filled with silica powder 91. A hemispherical aluminium reflector 92 conforming to the inner surface of the ball 90 is provided. This produces a particularly robust arrangement. The ball is preferably polypropylene or ABS or other plastics material having low radar absorption. The ball is made in two halves and into one is fitted a hemispherical pressed aluminium reflector. The two halves of the ball are then adhered together and the ball filled with the silica powder through a hole 93. During filling, the ball 90 is agitated to ensure that the filling is complete. After filling the hole 93 is sealed.

Although the lenses described thus far have had spherical forward and rearward reflecting surfaces, it has been found that for particular design applications the lens surfaces may be optimised analytically. One such arrangement is shown in FIG. 10. A hollow plastics shell 100 is filled with silica powder 101 as in the FIG. 9 arrangement. The shell is formed from two similar, but different, halves, a forward half 102 and a rearward half 103 provided with a metallic lining 106. The lens is symmetrical about the axis 104 and the shell surfaces are so formed that the radius of curvature at a surface position 105 decreases as the distance d of the point from the axis of symmetry 104. The radii of curvature of the two halves differ on the axis 104 but become the same as d increases. This arrangement is lighter than a spherical lens-reflector of similar radar cross-section and also its specific shape can be tailored to produce a broader angular response than the arrangements described previously. The radar cross-section is such that a high reflectivity is obtained for substantially all incidence angles when two such lens-reflectors are arranged back-to-back: each lens-reflector having a substantially uniform reflection response throughout a solid angle of about $2\pi$. When using a spherical lens-reflector, as with the prior art Luneberg lenses, reflection takes place only within about an angle of 60°. With the non-spherical arrangement shown in FIG. 10 the front-back asymmetry has been found to give a slightly divergent return beam spreading through a contained angle of about 30° back along the line of incidence. This has been found to give better performance than for a lens-reflector giving parallel reflection and is particularly of benefit when source and receiver are not colocated. Then, providing source and receiver subtend an angle at the target of less than 15° the receiver will receive reflected radiation from the target.

One of the advantages of the powder packed shell lens compared with the lens made using an adhesive binder is that there is no non-uniformity of performance due to trapped air within the lens.

An alternative approach to the described use of solid lenses would be to use plastics material appropriately foamed with an inert gas and loaded with a particulate filler selected to achieve the required dielectric constant. A useful combination has been found to be a polyurethane foam with a powdered slate filler. This lens could be provided with a reflecting metallic coating but preferably the foamed material is formed within a polypropylene shell provided with a reflector as in the arrangements of FIGS. 9 and 10.

In an application such as a radar reflector for the masthead of a boat, two back to back lenses of the type shown in FIG. 10 will provide substantially omnidirectional reflectance. An alternative arrangement involving a single lens is shown in FIG. 11. Shown in dashed lines are two back-to-back spherical lenses 111 and 112 with a solid double reflector 113 between the two lenses. The reflector 113 is cylindrical with a radiused reflecting surface 114,115 at each end. Such an arrangement of lenses and reflector is equivalent to the combination of lens-reflectors described above to give substantially omnidirectional performance. In the FIG. 11 arrangement, however, the spherical lenses 111 and 112 are replaced by a single enveloping spherical lens 116. A polypropylene spherical shell 117 has attached diametrically opposed spigots 118,119 which support the double reflector 113 centrally within the spherical lens 116. The remaining cavity within the shell 117 is filled as before with a suitable dielectric particulate material such as silica flour. The structural integrity of this arrangement can be improved by using a foamed resin lens with a particulate filler, replacing the silica flour The lens-reflector assembly could then be used without an ecapsulating shell although in practice a polypropylene shell will provide protection for the foam lens.

The foamed plastics lens arrangements are lighter than the other embodiments of the invention described and thus are advantageous for applications where weight limitation is an important criterion.

Other variations and modifications of the lensreflectors described above will be apparent to those skilled in the art, all falling within the scope of the invention claimed.

We claim:

1. A passive radar target comprising:

a lens comprised of a radar transparent shell; and a particulate material of substantially uniform dielectric constant filling said shell such that there are substantially no voids; and a reflecting surface integrally formed with said shell, said particulate material having a dielectric constant substantially equal to 3.4 such that radar waves striking the surface of the lens are focussed on the reflecting surface, said particulate material being finely powdered and compacted inside said shell.

2. A passive radar target as claimed in claim 1 wherein said reflecting surface is located inside said lens.

3. A passive radar target as claimed in claim 2 wherein said reflecting surface is a sprayed coating.

4. A passive radar target as claimed in claim 2 wherein said lens is axially symmetrical having forward and rearward surfaces, said reflecting surface is in contact with said rearward surface and wherein said forward and rearward surfaces have a radius of curvature that decreases with distance (d) from said axis of symmetry.

5. A passive radar target as claimed in claim 4 wherein said forward and rearward surfaces have differing radii of curvature at said axis of symmetry.

6. A passive radar target as claimed in claim 5 wherein said particulate material of said lens comprises silica flour.

7. A passive radar target as claimed in claim 1 wherein said shell is comprised of polycarbonate material.

8. A passive radar target as claimed in claim 1 wherein said shell is comprised of two portions, a forward and a rearward portion, and said reflector comprises a metal pressing inserted inside said rearward portion.

9. A passive radar target as claimed in claim 1 wherein said reflecting surface includes a vaned grid so that said radar target can be used for circularly polarized radar.

10. A passive radar target as claimed in claim 1 wherein said reflector is centrally located within said lens.

11. A passive radar target as claimed in claim 9, wherein said reflector comprises a body with two outwardly facing opposed concave reflecting surfaces.

* * * * *